United States Patent [19]

Dowding et al.

[11] Patent Number: 4,747,743

[45] Date of Patent: May 31, 1988

[54] CONVEYING APPARATUS FOR ROD-LIKE ARTICLES

[75] Inventors: John G. Dowding, Dallington Northampton; David M. Hawkins; Robert J. C. Southwood, both of High Wycombe, all of England

[73] Assignee: Molins PLC, United Kingdom

[21] Appl. No.: 836,556

[22] Filed: Mar. 6, 1986

[30] Foreign Application Priority Data

Mar. 6, 1985 [GB] United Kingdom ..... 8505804

[51] Int. Cl.[4] ..... A24C 5/35

[52] U.S. Cl. ..... 414/403; 198/409; 198/468.6; 414/422

[58] Field of Search ..... 414/403, 404, 419–422, 414/425; 198/409, 417, 468.6, 463.4, 465.1, 346.1; 131/281–283, 107

[56] References Cited

U.S. PATENT DOCUMENTS

| | | | |
|---|---|---|---|
| 2,835,372 | 5/1958 | Biddison | 198/463.4 X |
| 3,672,522 | 6/1972 | Wahle et al. | 414/421 |
| 3,703,242 | 11/1972 | Marradi | 414/403 X |
| 3,883,017 | 5/1975 | Shirai et al. | 414/421 X |
| 4,585,386 | 4/1986 | Gömann et al. | 414/403 |

FOREIGN PATENT DOCUMENTS

| | | | |
|---|---|---|---|
| 1042142 | 8/1975 | United Kingdom . | |
| 1430061 | 3/1976 | United Kingdom . | |
| 1547809 | 6/1979 | United Kingdom | 414/403 |
| 1557458 | 12/1979 | United Kingdom . | |
| 2024758 | 1/1980 | United Kingdom | 414/403 |
| 2072119 | 9/1981 | United Kingdom | 414/403 |
| 2142894 | 1/1985 | United Kingdom | 414/403 |
| 2157252 | 10/1985 | United Kingdom . | |

*Primary Examiner*—Joseph E. Valenza
*Assistant Examiner*—David A. Bucci
*Attorney, Agent, or Firm*—Antonelli, Terry & Wands

[57] ABSTRACT

A conveyor system linking a cigarette making machine and a cigarette packing machine includes a container buffer reservoir (42) having a tray filler (20) and a tray unloader (22), each arranged so that the cigarettes are disposed in the transfer position at 90° to those in the main conveyor (10). Twisted downdrops (16, 32) are provided in the conveyors leading to the tray filler (20) and from the tray unloader (22). Tray transport conveyors (44, 46) extend between the tray filler (20) and tray unloader (22) parallel to the main conveyor (10), and include lateral delivery and receiving slides (68, 70) for full trays. An inclined pivoted guide (62) is provided for transfer of empty trays (64) from the tray unloader (22, 24) to a transport conveyor (44).

13 Claims, 4 Drawing Sheets

CONVEYING APPARATUS FOR ROD-LIKE ARTICLES

This invention relates to apparatus for conveying rod-like articles, particularly articles of the tobacco industry such as cigarettes or filter rods.

In the cigarette industry it is common to link a machine for producing rod-like articles, e.g. a cigarette machine or filter rod making machine, to a receiving machine, e.g. a cigarette packing machine or filter rod pneumatic distribution system, by way of a conveyor system which includes a buffer reservoir for accommodating temporary differences in supply and demand. Such conveyor systems are known in which the buffer reservoir comprises means for loading and unloading containers. Examples of such systems are disclosed in British patent specifications Nos. 1404142, 1557458, and 2142894.

According to one aspect of the invention apparatus for conveying rod-like articles comprises an article delivery device, an article receiving device, conveyor means for conveying articles away from the delivery device and for conveying articles towards the receiving device, said conveyor means being arranged to convey articles in multi-layer stack formation, a container loading position, a container unloading position, a first subsidiary conveyor linking the container loading position with said conveyor means, a second subsidiary conveyor linking the container unloading position with said conveyor means, and a container handling system including means for conveying a container between said loading and unloading positions, wherein each of said loading and unloading positions is arranged such that articles are disposed in said positions at 90° to articles in said conveyor means, said container unloading position being arranged upstream of said container loading position relative to the direction of movement of articles on said conveyor means, and said container handling system includes means for conveying containers between said loading and unloading positions in a direction generally parallel to the path of said conveyor means adjacent said loading and unloading positions.

In a preferred arrangement the junction of the first subsidiary conveyor with said conveyor means is arranged upstream of that of the second conveyor means. Each of said first and second subsidiary conveyors may include means for turning articles through 90°, preferably about an axis transverse to the lengths of the articles and in a downwardly-extending path portion. In a further preferred arrangement the second subsidiary conveyor includes a first portion including said means for turning articles, said first portion also including means for conveying articles downwards, and a second portion including means for conveying articles upwards. The second portion may extend generally parallel to an adjacent part of said conveyor means. The second portion of the second subsidiary conveyor and said adjacent portion of the conveyor means may be inclined (e.g. at 60° to the horizontal).

According to another aspect of the invention, apparatus for conveying rod-like articles comprises an article delivery device, an article receiving device, conveyor means for conveying articles away from the delivery device and for conveying articles towards the receiving device, said conveyor means being arranged to convey articles in multi-layer stack formation, a container loading position, a container unloading position, a first subsidiary conveyor linking the container loading position with said conveyor means, a second subsidiary conveyor linking the container unloading position with said conveyor means, and a container handling system including means for conveying a container between said loading and unloading positions, said container conveying means including means for elevating a container and further including means for transferring containers to or from said container conveying means in a lateral direction. Such lateral transferring means may be used to deliver or extract a full (or empty) tray to or from the container handling system. For example, full trays may be extracted from the path of the container elevating means. Means may be provided for supplying full (or empty) containers by similar lateral movement to an appropriate part of the system (i.e. full trays to be delivered to the system where full trays are expected, and empty trays to be delivered to the system where empty trays are expected). The or each lateral delivering means may include means for lifting or lowering a container as it is being delivered, for example so that it may be delivered for removal by an operator at a convenient height. The lateral delivering means might also turn the container about a substantially vertical axis, so that the container is presented at the most convenient orientation.

According to a further aspect of the invention apparatus for conveying rod-like articles comprises a container loading position, a container unloading position, and a container handling system including means for conveying a container between said loading and unloading positions, said container handling system including a full container conveyor at a first level, an empty container conveyor at a second level which is higher than said first level, means for elevating full containers from said first level to a third level which is higher than said second level and at which the contents of the container are discharged and successive full containers converted into empty containers, and means for returning an empty container from the third level to the second level, said returning means operating in the path of said elevating means and being arranged to allow said elevating means to move a full container past said returning means. Said returning means may include means for conveying empty containers in an inclined position, and means may be provided for moving said containers into a substantially upright condition on said empty container conveyor. The elevating means may include means for removing a full container at a position intermediate said first and third levels.

The invention will be further described, by way of example only, with reference to the accompanying drawings, in which.

Figure 1:
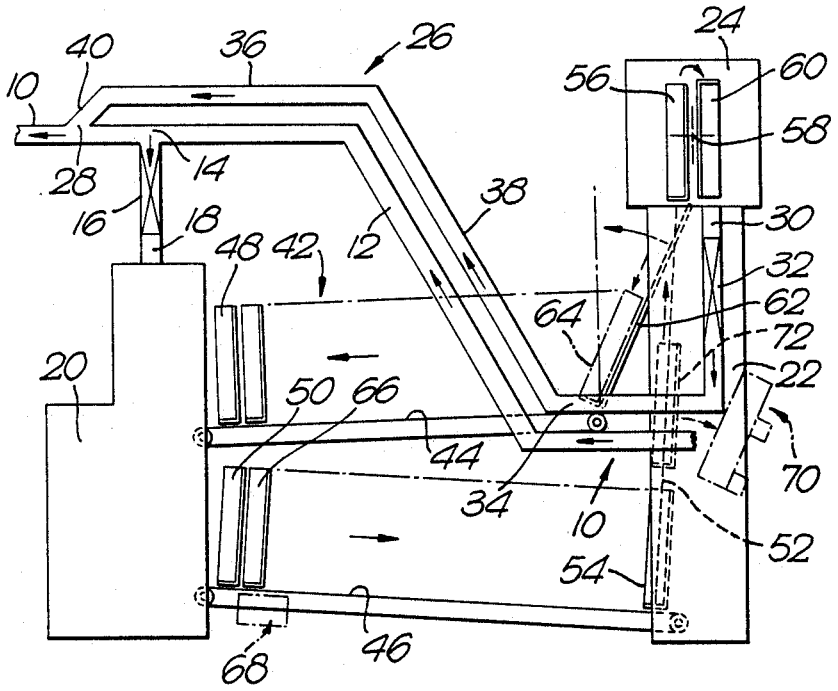
FIG. 1 is a side view of a conveyor system for cigarettes.

The conveyor system includes a main conveyor 10 linking a cigarette making machine M with a cigarette packing machine P and including an inclined elevator section 12. The conveyor 10 has a junction 14 adjacent the upper end of the elevator 12. A downdrop or chute 16 having a 90° twist extends downwardly from the junction 14 and leads via a substantially horizontal conveyor section 18 to a tray filling machine 20.

A tray unloading machine 22 having a tray inverting unit 24 is linked by a subsidiary conveyor 26 to a further junction 28 on the main conveyor 10, arranged downstream of the junction 14. The conveyor 26 includes a substantially horizontal portion 30 extending from the tray inverter unit 24, a 90° spiral twisted downdrop 32, substantially horizontal sections 34, 36 separated by an inclined elevator section 38, and a short downwardly inclined portion 40 leading to the junction 28. The horizontal portion 30 could be replaced by a downwardly-inclined portion leading to a twisted downdrop somewhat shorter than the downdrop 32.

The conveyors 10, 26 are arranged in a generally similar manner to those shown in British patent specification No. 2157252 and may be controlled in a similar manner. The elevators 12, 38 may be substantially as disclosed in British patent specification No. 2154534. Reference is directed to these specifications for further details.

The tray filling machine or tray filler 20 and the tray unloading machine or tray unloader 22 are each arranged at 90° to the main conveyor 10, i.e. in and immediately adjacent the tray filler and tray unloader the cigarettes are disposed at 90° to the cigarettes on the main conveyor 10. The spiral downdrop 16 twists the cigarettes through 90° for delivery from the junction 14 to the tray filler input conveyor 18. Similarly the spiral downdrop 32 twists the cigarettes through 90° from their orientation on the tray filler output conveyor 30 for delivery to the horizontal section 34 of the subsidiary conveyor 26. Note that in view of the 180° change in orientation caused by insertion of a full tray in the tray inverter 24 the downdrops 16 and 32 twist the cigarettes in the same direction through 90°, i.e. the total change in orientation caused by the downdrops is 180°, to compensate for the 180° insertion in the tray inverter. Each of the downdrops 16, 32 may be substantially as described in British patent specification No. 1430061.

The tray filling machine 20 and the tray unloading machine 22 are linked by a common tray conveyor and reservoir system 42. The system 42 includes an upper empty tray conveyor 44 for receiving empty trays from the tray unloading machine 22 and for delivering empty trays to the tray filling machine 20. The system 42 also includes a lower full tray conveyor 46 for receiving full trays from the tray filling machine 20 and for delivering full trays to the tray unloading machine 22. The conveyors 44 and 46 each comprise laterally spaced bands and may be driven continuously, cooperating with gates or clamps which control movement of the trays, or intermittently. Each of the conveyors 44, 46 is unidirectional, and is inclined downwardly slightly in the direction of conveyance (e.g. by an angle of about 3°-6° to the horizontal). The empty trays are more stable and full trays retain their contents better on downwardly-inclined conveyors as shown.

The tray filling machine 20 may be substantially as disclosed in British patent specification No. 2124174 and converts an empty tray 48 delivered on the conveyor 44 progressively into a full tray 50 subsequently delivered to the conveyor 46. Reference is directed to said specification for details of the tray filling operation.

The tray unloading machine 22 includes an elevator 52 for lifting a full tray 54 on the lower conveyor 46 into the position occupied by the full tray 56 in the tray inverter 24. The tray inverter 24 comprises a pair of carriers for receiving trays and is pivotable about a substantially horizontal axis 58 to move the tray 56 into the position occupied by the tray 60 from which the contents of the tray are unloaded for delivery onto the conveyor 30.

Figure 3:
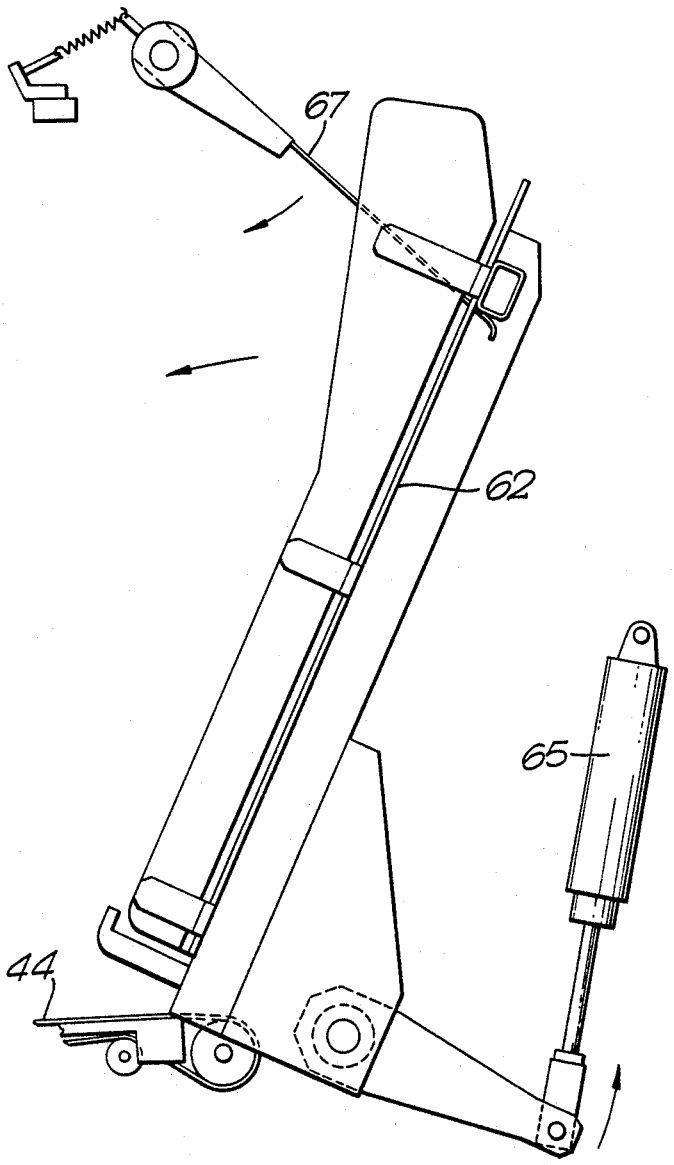
FIG. 3 is a side view of part of the system of FIG. 1.

Rotation of the carriers of the tray inverter 24 about the axis 58 causes the now empty tray previously in the position of tray 60 to be returned to the position of tray 56. Referring also to FIG. 3, this empty tray is delivered down an inclined guide 62 to the position of tray 64 (FIG. 1), which is partially supported on the end of the empty tray conveyor 44. When the tray reaches the position of tray 64 the guide 62 is pivoted by an air cylinder 65, to an upright position, as indicated in FIG. 1, and the tray 64 is subsequently moved away on the conveyor 44. The final movement of the cylinder 65 is gentle so that the tray remains stable on the conveyor 44 after being placed there. Note that the guide 62 is retractable away from the path of a full tray being moved by the elevator 52. In an alternative arrangement the guide 62 may be lightly resiliently loaded into the position where it may collected an empty tray moving from the position of tray 56 and merely be moved aside by a tray being lifted by the elevator 52. In this case separate means may be provided for moving the tray 64 into a relatively upright condition on the conveyor 44.

As the empty tray descends on the guide 62 it is engaged by a spring-loaded pivoted flap 67 (FIG. 3) which presses the tray into position on the guide and helps to control its descent. The flap 67 becomes disengaged with the tray before it reaches the conveyor 44.

Other means for delivering full and empty trays to and from a tray inverter similar to the tray inverter 24, are described and illustrated in British patent specification No. 2142894, to which reference is directed for further details. This specification also discloses details of a tray inverter 24 and certain other details of tray conveying systems applicable to the present arrangement.

Cigarettes are delivered into trays by way of the tray filling machine 20 when the speed of the making machine exceeds that of the packing machine. Similarly, cigarettes are delivered from trays by way of the tray unloading machine 22 onto the conveyor 26 and subsequently onto conveyor 10 when the speed of the making maching is less than that of the packing machine. In the event that more than one empty tray requires to be filled with cigarettes from the conveyor 10 successive empty trays are delivered on the conveyor 44 to the tray filling machine 20. Similarly, if more than one full tray needs to be unloaded by the tray unloading machine 22 successive full trays are delivered to the elevator 52 on the conveyor 46.

Figure 2:
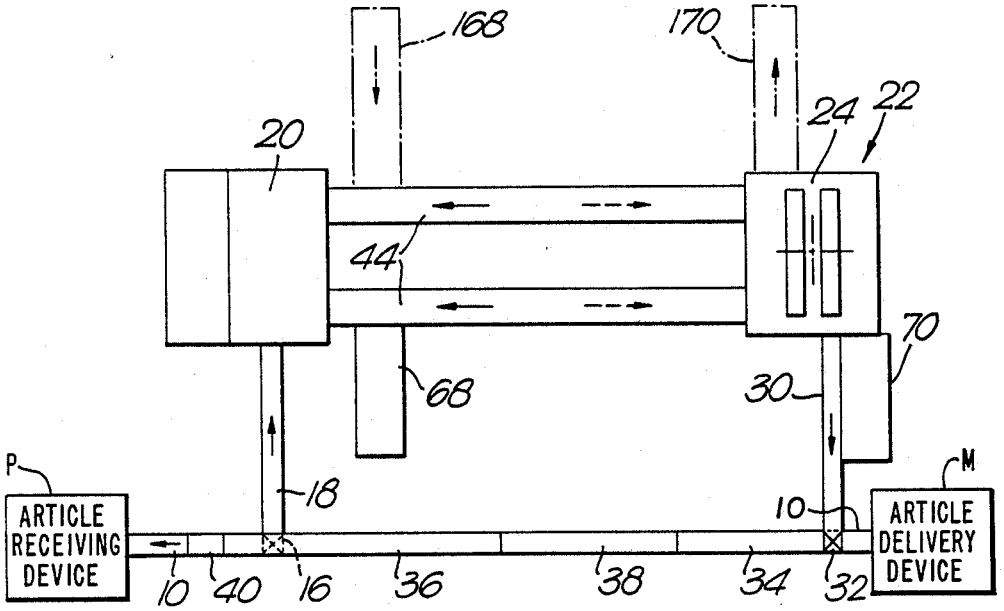
FIG. 2 is a plan view of the system of FIG. 1.

A limited number of full and empty trays may be accommodated on the conveyors 44 and 46. If this buffering capacity is insufficient full and/or empty trays may be removed or supplied manually. Provision is made for supply of full trays to the conveyor 46 at a position substantially in alignment with the full tray 66 (FIG. 1) by a slide mechanism 68 (FIG. 2). The mechanism 68 is described below with reference to FIGS. 5 and 6. Alternatively, the mechanism 68 may be substantially similar to the mechanism 150–160 described and illustrated with reference to FIG. 17 of British patent specification No. 2142894, although the longitudinal movement of the slide may be carried out manually rather than be a drive and, similarly, a cam may be provided to lift and lower the tray onto the tray conveyor 46. Thus with reference to said FIG. 17 of said specification the movement on the track 156 and slide 160 may be achieved manually.

Figure 5:
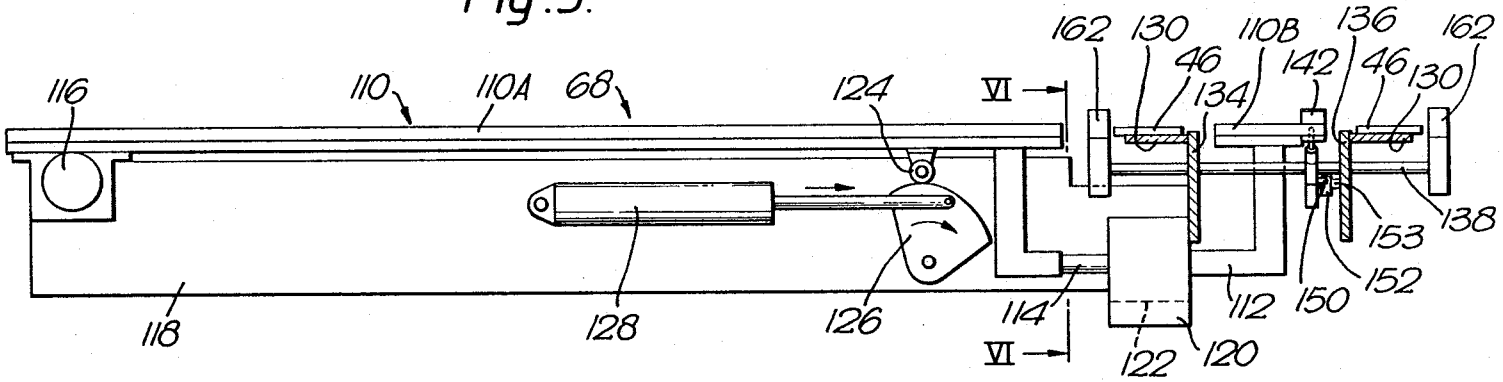
FIG. 5 is a side view of a further part of the system of FIG. 1.
Figure 6:
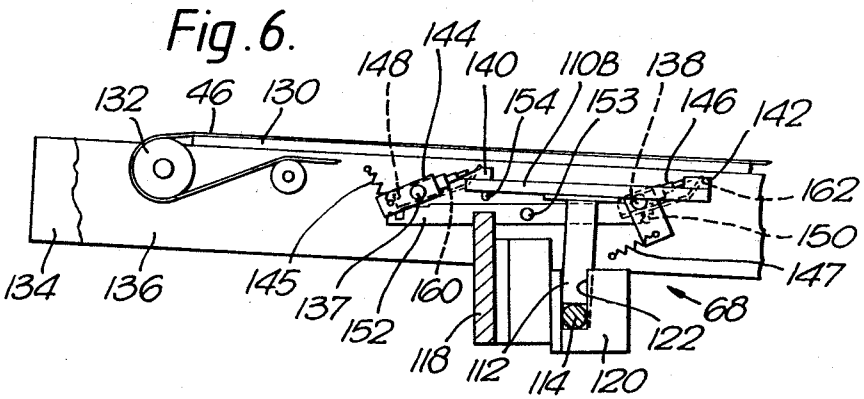
FIG. 6 is a sectional view on the line VI—VI in FIG. 5.

The mechanism 68 shown in FIGS. 5 and 6 comprises a slide 110 having an inner portion 110A and an outer portion 110B interconnected by a generally U-shaped bracket 112 including a connecting rod 114. The slide 110 is pivoted at 116 to a cross beam 118 which is connected to a frame member 120 of the tray handling system 42. The lower portion of the bracket 112 is movable in a recess 122 of the member 120. The slide portion 110A carries a cam roller 124 in contact with a cam quadrant 126 connected to a piston and cylinder 128. The cam quadrant 126 and piston and cylinder 128 are pivotally connected to the cross beam 118.

The conveyor 46 comprises laterally spaced bands supported on inclined plates 130 and passing around pulleys 132. Longitudinal struts 134, 136 support the plate 130 by means of brackets (not shown).

The slide outer portion 110B includes members 140, 142 spaced by a distance just exceeding the width of a tray and having inclined faces adapted to co-operate with pivoted members 144, 146. The members 144, 146 are carried on spindles 137, 138 passing through the struts 134, 136. At the outer end of each spindle 137, 138 are pairs of stop members 160, 162. The members 144, 146 are biased by springs 145, 147 connected to the strut 136 and carry pins 148, 150 engageable in recesses in a link 152 pivoted at 153 to the strut 136. The lower surface of the slide portion 110B carries an abutment 154 arranged to engage the link 152 at certain times.

The slide 110 is in its uppermost position as shown in FIG. 5. A tray may be moved along the slide to a position just above the bands of conveyor 46. By operation of the piston and cylinder 128 and rotation of the cam 126 the slide 110 is lowered to deposit the tray on the bands. In the uppermost position of slide 110 the members 144, 146 are maintained in an upper position by engagement of the pins 148, 150 respectively with recesses in and at the end of the link 152 (i.e. in a position rotated anti-clockwise from that shown in FIG. 6) so that the spindles 137, 138 are turned and the stop members 160, 162 extend above the level of the conveyor 46 and prevent passage of trays on the conveyor to or from the position of the slide 110.

During lowering of the slide 110 the abutment 154 pushes the link 152 so that it turns about its axis 153 and the pins 148, 150 are released from engagement by the link, and springs 145, 147 rotate the members 144, 146 into the retracted positions shown in FIG. 6. Corresponding rotation of the spindles 137, 138 moves the stop members 160, 162 into position below the level of conveyor 46 (as shown in FIG. 6), thereby allowing passage of trays on the conveyor 46. When it is again required to slide a full tray onto the conveyor 46 the slide 110 is moved upwards and causes the members 140, 142 to rotate the stop members 144, 146 in an anti-clockwise direction by an amount sufficient to move the pins 148, 150 into engagement again with the link 152, thus setting the stop members 160, 162 to prevent passage of trays on the conveyor 46 until the slide is once again lowered.

Means is also provided for extracting a full tray from the system. This means comprises a mechanism 70 arranged to cooperate with the elevator 52 to extract a full tray from the region of an intermediate position 72. The mechanism 70 is described below with reference to FIG. 4. Alternatively, a slide mechanism similar to the slide 68 may be provided for extracting the tray at position 72 from the elevator lifting fork. The arrangement may be such that a tray is normally elevated directly from the conveyor 46 to the tray inverter 24 but by manual intervention a tray may be temporarily arrested at the intermediate position 72 for withdrawal by means of the slide mechanism 70.

Figure 4:
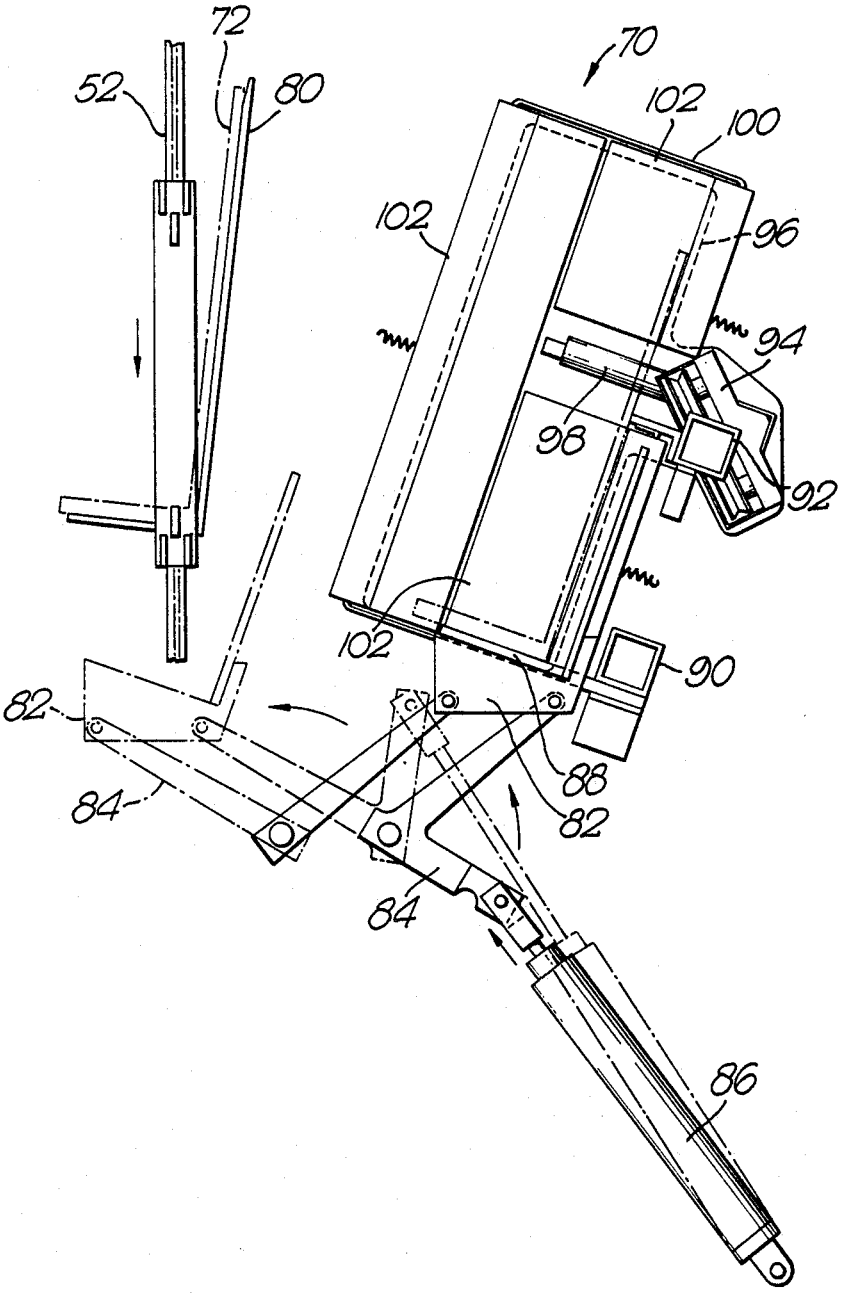
FIG. 4 is a side view of another part of the system of FIG. 1.

FIG. 4 shows the full tray extraction mechanism 70. A tray supported on a cradle 80 of the elevator 52 is shown at the intermediate position 72. The mechanism 70 includes a tray support 82 carried by a pivoted parallelogram linkage 84 and movable by action of a pivoted piston and cylinder 86 between a first position (in chain dot line) in which the elevator 52 may on demand deposit a tray on the support 82 and a second position (in full line) in which the tray is deposited on a slide 88. A rail 90 supports the slide 88 and extends outwards from the tray unloader 22. A further rail 92 extends parallel to the rail 90 and supports a bearing housing 94 to which is connected a backing plate 96 and a handle 98.

The arrangement is such that when a full tray is required to be extracted the operator signals the demand and as soon as a full tray is available at the intermediate position 72 the support 82 is moved into the first position and the elevator 52 lowers the tray from the intermediate position onto the support. The piston and cylinder 86 then moves the full tray and support 82 into the second position, so that the tray is on the slide 88. In this second position the tray is still in alignment with the intermediate position 72 and is within the housing of the tray unloader 22. In order to extract the tray for subsequent removal the operator grasps the handle 98 and pulls so that the bearing housing 94 is moved outwards along the rail 92. At the same time the plate 96, connected to the bearing housing 94, engages the tray and slides at along the slide 88. The tray passes through an aperture 100 in the side of the housing of the tray unloader 22 and temporarily pushes aside pivoted gates 102 which normally shield the aperture.

Instead of providing the full tray insertion and extraction mechanisms 68, 70 in the positions shown in FIG. 2, alternative mechanisms 168, 170 could be provided on the opposite side of the reservoir system 42. In another possible arrangement the system 42 is located on the opposite side of the conveyor 10, preferably with the full tray and extraction mechanism extending in a direction away from the conveyor 10.

Reference is directed generally to British patent specification No. 2142894 for its showing of various sytems having a similar function to that of the present application and for its teaching of details of construction and operation applicable to that of the present invention.

With reference to the system of FIGS. 12–18 of British patent specification No. 2142894 an alternative arrangement in which a unidirectional tray reservoir 94 may be provided consists of arranging that the full tray turn device FTT turns the full trays through 90° to the left rather than to the right as shown in FIGS. 13 and 14. This also has the advantage of providing better access to full trays being delivered from the tray filler.

In a further possible modification of the system of said FIGS. 12–18 of said specification, the tray reservoir 94 is omitted and the full tray reservoir FR lengthened so that it extends beyond the end of the empty tray reservoir ER and empty tray turn device ETT. The full trays are then elevated (without turning) from the end of the extended full tray reservoir to a level higher than that of the empty tray reservoir ER. At this higher level a new full tray turn device is provided to turn the full trays towards the tray inverter TI from which they are elevated a short distance into the carrier of the tray inverter. Empty trays are delivered to the empty tray turn device ETT and empty tray reservoir ER as before.

We claim:

1. Apparatus for conveying rod-like articles, comprising an article delivery device an article receiving device; conveyor means for conveying articles away from the delivery device and for conveying articles towards the receiving device, said conveyor means being arranged to convey articles in multi-layer stack formation; a container loading position; a container unloading position; a first subsidiary conveyor linking the container loading position with said conveyor means; a second subsidiary conveyor linking the container unloading position with said conveyor means; and a container handling system including container conveying means for conveying a container between said loading and unloading positions, said container conveying means including means for elevating a container and means for transferring containers to or from said container conveying means in a lateral direction, said transferring means including first means for moving a container in a lateral direction into a transfer position at least partly in the path of said container conveying means and second means for arresting a container on said container conveying means adjacent and upstream of said transfer position so that said moving means may introduce a container onto said container conveying means between containers already on said container conveying means, said lateral direction and said path being substantially horizontal and relatively transverse and intersecting at said transfer positions.

2. Apparatus as claimed in claim 1, wherein said transferring means includes means for delivering containers from the path of said container elevating means.

3. Apparatus as claimed in claim 2, wherein said container elevating means has an intermediate position for containers, including means for diverting a container from said elevating means at said intermediate position and for delivering it along a transverse path to said transferring means.

4. Apparatus as claimed in claim 1, wherein said transferring means includes means for lowering a container from said transfer position onto said container conveying means.

5. Apparatus as claimed in claim 1, wherein the transferring means includes means for sliding a container along a lateral guide.

6. Apparatus for conveying rod-like articles, comprising an article delivery device, an article receiving device, conveyor means for conveying articles away from the delivery device and for conveying articles towards the receiving device, said conveyor means being arranged to convey articles in multi-layer stack formation, a container loading position, a container unloading position, a first subsidiary conveyor linking the container loading position with said conveyor means, a second subsidiary conveyor linking the container unloading position with said conveyor means, and a container handling system including means for conveying a container between said loading and unloading positions, said container conveying means including means for elevating a container and means for transferring containers to or from said container conveying means in a lateral direction, said transferring means including means for delivering containers from the path of said container elevating means, wherein said delivering means includes a first device for removing containers from the path of said conveyor elevating means in a first direction and a second device for delivering containers in a lateral second direction.

7. Apparatus as claimed in claim 6, wherein said first device includes at least on articulated member pivotable about an axis substantially transverse to the articles in a container moved by said device.

8. Apparatus for conveying rod-like articles, comprising a container loading position, a container unloading position, and a container handling system including means for conveying a container between said loading and unloading positions, said container handling system including a full container conveyor at a first level, an empty container conveyor at a second level which is higher than said first level, means for elevating full containers from said first level to a third level which is higher than said second level and at which the contents of the container are discharged and successive full containers converted into empty containers, and means for returning an empty container from the third level to the second level, said returning means operating in the path of said elevating means and comprising inclined guide means for directing an empty container from the path of said elevating means and being arranged to allow said elevating means to move a full container past said returning means.

9. Apparatus as claimed in claim 8, wherein said returning means includes means for conveying empty containers in an inclined position.

10. Apparatus as claimed in claim 9, wherein said returning means includes means for moving said containers into a substantially upright condition on said empty container conveyor.

11. Apparatus as claimed in claim 8, wherein said inclined guide means is movable between a position in the path of said elevating means and a position spaced from said path.

12. Apparatus for conveying rod-like articles, comprising a container loading position, a container unloading position, and a container handling system including means for conveying a container between said loading and unloading positions, said container handling system including a full container conveyor at a first level, an empty container conveyor at a second level which is higher than said first level, means for elevating full containers from said first level to a third level which is higher than said second level and at which the contents of the container are discharged and successive full containers converted into empty containers, and means for returning an empty container from the third level to the second level, said returning means operating in the path of said elevating means, being arranged to allow said elevating means to move a full container past said returning means, wherein said returning means including means for conveying empty containers in an inclined position, means for moving said containers into a substantially upright condition on said empty container conveyor and a guide movable between an inclined first position in which empty trays are received and guided into a position adjacent the empty container conveyor and a substantilly upright second position from which empty containers are received by said empty container conveyor.

13. Apparatus as claimed of claim 8, wherein said elevating means has an intermediate position between said first and third levels, including means for removing a full container from said intermediate position.

* * * * *